US011617400B2

(12) United States Patent
Gangan et al.

(10) Patent No.: US 11,617,400 B2
(45) Date of Patent: Apr. 4, 2023

(54) INFANT ANTI-FLAIL GARMENT

(71) Applicants: Manasi Gangan, Hudson, MA (US); Susan Sofia-McIntire, Newburyport, MA (US)

(72) Inventors: Manasi Gangan, Hudson, MA (US); Susan Sofia-McIntire, Newburyport, MA (US)

(73) Assignee: Nested Bean, Inc., Hudson, MA (US)

( * ) Notice: Subject to any disclaimer, the term of this patent is extended or adjusted under 35 U.S.C. 154(b) by 0 days.

(21) Appl. No.: 16/926,810

(22) Filed: Jul. 13, 2020

(65) Prior Publication Data

US 2021/0007420 A1 Jan. 14, 2021

Related U.S. Application Data

(60) Provisional application No. 62/873,425, filed on Jul. 12, 2019.

(51) Int. Cl.
*A41D 11/00* (2006.01)
*A41B 13/06* (2006.01)

(52) U.S. Cl.
CPC ..... *A41D 11/00* (2013.01); *A41B 13/06* (2013.01)

(58) Field of Classification Search
CPC ..... A41D 11/00; A41B 13/06; A41B 13/00; A41B 13/08; A41B 13/065; A47G 9/08; A47G 9/083
USPC ..... 2/69.5
See application file for complete search history.

(56) References Cited

U.S. PATENT DOCUMENTS

| | | | | |
|---|---|---|---|---|
| 3,801,987 | A * | 4/1974 | Thompson, Jr. | A41D 27/10 2/125 |
| 9,179,711 | B2 * | 11/2015 | Krawchuk | A41B 13/06 |
| 10,455,865 | B2 * | 10/2019 | Barski | A41B 13/06 |
| 2005/0034204 | A1 * | 2/2005 | Kassai | A41B 13/08 2/69 |
| 2006/0064794 | A1 * | 3/2006 | Howard | A41B 13/08 2/69 |

(Continued)

OTHER PUBLICATIONS

Sleepea 5-Second Baby Swaddle, 2018, Happiest Baby https://web.archive.org/web/20181226055120/https://www.happiestbaby.com/products/sleepea-swaddle (Year: 2018).*

*Primary Examiner* — Katherine M Moran
*Assistant Examiner* — Haley A Smith
(74) *Attorney, Agent, or Firm* — Armis IP Law, LLC

(57) ABSTRACT

A sleeper garment for an infant employs an anti-flail receptacle for mitigating a startling sensation from a flailing reflex that is inherent in development. The receptacle occupies the sleeve region and provides a limited region of movement to accommodate a controlled degree of movement, but constrains the movement to avoid startling a sleeping infant awake. The receptacle has a semicircular or polygonal shape that allows hand and elbow flexure, and a elastic mesh periphery to provide an elastic, cushioned response toward the end of the allowed range of movement as the periphery of the receptacle stretches. The receptacle defines a periphery from the shoulder toward the torso. This provides a more settling response to the flail reflex than a tight swaddle, which restricts almost all movement, and may be combined with pressure accessories to provide further soothing sensations simulating a caregiver touch.

19 Claims, 8 Drawing Sheets

(56) References Cited

U.S. PATENT DOCUMENTS

| | | | | |
|---|---|---|---|---|
| 2011/0180079 | A1* | 7/2011 | Krawchuk | A41B 13/06 128/873 |
| 2012/0284922 | A1* | 11/2012 | Gangan | A41B 13/06 5/494 |
| 2013/0269080 | A1* | 10/2013 | Parker | A41B 13/06 2/69.5 |
| 2016/0128392 | A1* | 5/2016 | Krawchuk | A61F 5/37 128/873 |
| 2016/0295928 | A1* | 10/2016 | Bopanna | A41B 13/06 |
| 2017/0318984 | A1* | 11/2017 | Parker | A41B 13/06 |
| 2018/0103689 | A1* | 4/2018 | DeLisa | A41B 13/06 |
| 2018/0168240 | A1* | 6/2018 | Parker | A41B 13/06 |
| 2018/0317566 | A1* | 11/2018 | Barski | A47G 9/083 |
| 2021/0059319 | A1* | 3/2021 | Karp | A41B 13/065 |
| 2021/0235776 | A1* | 8/2021 | Krawchuk | A61F 5/37 |

* cited by examiner

INFANT ANTI-FLAIL GARMENT

RELATED APPLICATIONS

This patent application claims the benefit under 35 U.S.C. § 119(e) of U.S. Provisional Patent App. No. 62/873,425, filed Jul. 12, 2019, entitled "INFANT ANTI-FLAIL GARMENT," incorporated herein by reference in entirety.

BACKGROUND

Infants experience a so-called "flail" reflex when sleeping that has a tendency to awaken the infant and interrupt sleep cycles. An infant will suddenly thrust its arms in an upward motion in the direction of the head. The flail reflex is believed to result from a sensation of "falling" experienced by the infant, and is typically outgrown within several months. A sensation of a caregiver's touch or contact can mitigate the flail reflex, likely from conveyance of a safe, restraining feeling. The sooner into the flail movement such a touch is experienced, the less likely it is that sleep interruption will occur.

SUMMARY

A sleeper garment for an infant employs an anti-flail receptacle for mitigating a startling sensation from a flailing reflex that is inherent in human development. An infant experiencing this reflex will thrust their arms suddenly upward (toward the head) in a "flailing" movement, and may become unsettled or startled awake as a result. The receptacle occupies the arm region and provides a limited region of flexure or deformation to accommodate a controlled degree of movement, but gently constrains the movement to avoid startling a sleeping infant awake. The receptacle has a semicircular or polygonal concave shape that allows hand and elbow flexure, and a elastic mesh periphery to provide an elastic, cushioned response toward the end of the allowed range of movement as the periphery of the receptacle stretches slightly. The receptacle defines a periphery from the shoulder toward the torso, such that arm movement above the shoulder line is controlled by a resiliency of the mesh. This provides a more settling response to the flail reflex than a tight swaddle, which restricts almost all movement, and may be combined with pressure accessories to provide further soothing sensations simulating a caregiver touch.

Configurations herein are based, in part, on the observation that infants exhibit a so-called "flail" reflex. This reflex usually abates at several months of age, but when it occurs it can startle and/or awake a sleeping infant, compounding the already irregular sleep cycles typically found in early development. Unfortunately, conventional approaches to infant sleepwear suffer from the shortcoming that limbs (arms and legs) are either tightly bound inside a snug swaddle, or permitted free travel from loose fitting sleeves that allow an unrestricted flailing reflex, often raising the arms above the head in a sudden jolt. Accordingly, configurations herein substantially overcome the shortcomings of conventional sleepwear by providing an anti-flail garment having arm receptacles for permitting limited movement while preventing a sudden flailing of arms triggered by the flail reflex. The garment employs multiple fabrics or textiles having differing degrees of deformability, defined as an ability to stretch. A basal fabric defines the torso and leg regions, and a mesh material having a greater deformability forms closed-end receptacles at the location of conventional sleeves. The mesh is a resilient, deformable and partially transparent material with elastic properties that receive outstretched movement and gently exerts a resistive force to deformation imposed by the infants outstretched hand or arm. The resistive force serves to return the mesh to an undeformed position below the head opening, thus gently opposing the flail reflex.

The disclosed approach demonstrates an infant sleeping garment including a textile body adapted to engage an infant wearer of the garment and a closure on a front of the textile body for providing entry and exit of the infant from the garment. An opening for encircling a neck of a wearer defines an upper arm limit, and opposed arm receptacles flank the opening for receiving the arms of the infant. Each of the opposed arm receptacles have a resilient mesh adapted to engage the arms and exert a resistive force responsive to restrict arm movement from extending above the opening in a direction of the head.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The anti-flail garment is depicted below in several configurations. Other configurations may also be envisioned, such as different closures, materials and placement of pressure accessories or absence of pressure accessories. The garment may be employed as an alternative to conventional infant sleepers and swaddling blankets for promoting sleep habits.

An elastic or resilient mesh integrated in a sleeve region of an infant garment allows limited movement of an infant's arms in any direction until encountering resistive pressure from the elasticized sleeve. The resistive effect occurs at or before the infant raises the arms above the shoulder line, and provides a comforting sensation as the infant senses the mesh resiliently engaging the arm and exerting a slight tensioning force. The garment takes the form of head-to-toe infant apparel having a zippered closure and common pouch for both legs. Pressure accessories such as those described in U.S. Pat. Nos. 9,572,376 and 8,863,329, the disclosures of which are hereby incorporated by reference, are also included. The sleeves take the form of a closed, semicircular receptacle or protrusion attached by a zippered seam for removal as infant growth proceeds. The mesh portion occupies the outer, middle or inner perimeter of the sleeve shape, and the optional zipper provides selective attachment across a diameter of the semicircle where the sleevelike receptacles join the garment.

The receptacle has a fixed or rest position that does not rise above or beyond the shoulder line of the garment. Therefore, a restrained sensation to a flailing action is perceived sooner, rather than at a point where the arms have risen well above the shoulders, as with conventional approaches. By engaging the arms early into the flail action, the resilient mesh contacts the arm and begins exerting the resistive force that calms the infant. Rather than outright tensioned restriction of the arms, the semicircular shape allows freedom of movement and partial upward displacement in a flail response, but limits movement such that the resilient mesh engages and contacts the moving arms before a full flail response awakens the infant.

Figure 1:
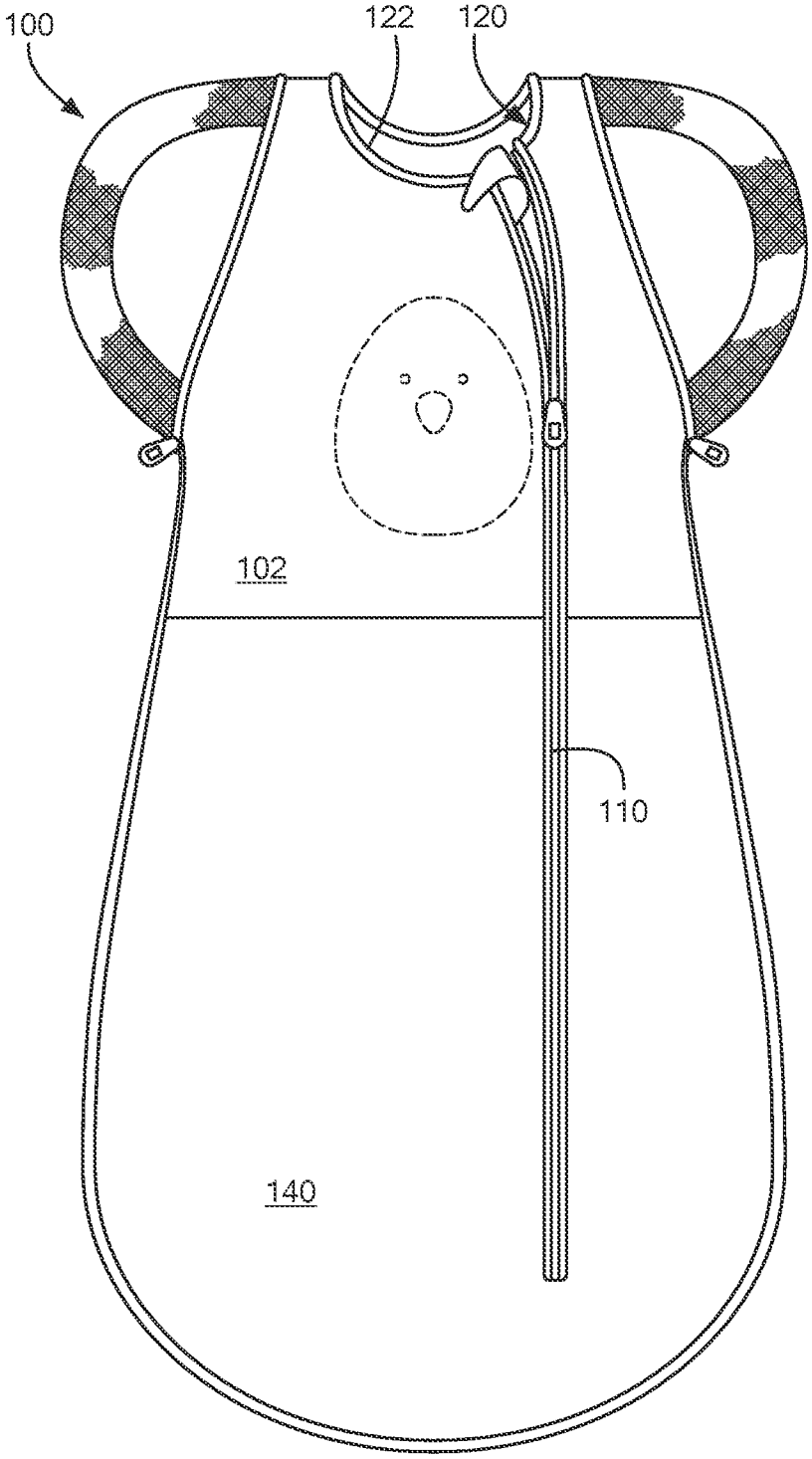
FIG. 1 shows a frontal view of the full infant garment.

FIG. 1 shows a frontal view of the full infant garment 100. Referring to FIG. 1, the garment 100 is accessed through a zippered closure 110 and surrounds the infant with an opening 120 for the head, defined by a neck perimeter 122. A textile body 102 is adapted to engage an infant wearer of the garment 100. The closure 110 on a front of the textile body 102 is for providing entry and exit of the infant from the garment 100. An opening 120 joins with the closure 110 for receiving the head and neck of the wearer. Opposed arm receptacles 150-1 . . . 150-2 (150 generally) flank the opening 120 for receiving the arms of the infant wearer, and each of the opposed arm receptacles has a resilient mesh 152 is adapted to engage the arms and exert a resistive force responsive to restrict arm movement of the arms from rising above the opening 120 in a direction of the head. The arm receptacles 150 are closed, in contrast to conventional sleeves, forming a pocket or pocket-like structure with the inner torso region, but allow free movement of the arms within the pocket and permit slightly restrained or moderated movement against the elasticized mesh as the mesh stretches in response to an outstretched arm.

The elastic or resilient mesh 152 is integrated in lieu of open sleeves of an infant garment for allowing limited movement of an infant's arms until encountering the resistive pressure from the elasticized arm receptacle 150. The resistive effect occurs at or before the infant raises the arms above the shoulder line, and provides a comforting sensation as the infant senses the mesh resiliently engaging the hand and arm and exerting a slight tensioning force. The slight resistive force can be perceived as a touch or contact with a caregiver, discussed further below.

The garment 100 therefore employs a dual construction including a basal fabric and the resilient mesh 152 of a more elastic, resilient and/or stretchable material for the receptacles 150. While the basal fabric is flexible, the mesh 152 allows a greater degree of deformability than the basal fabric. The elastic mesh 152 generally forms the receptacles 150, at a shoulder region below a shoulder or neck opening 120, which form the arm limit at the neck opening 122, above which the elastic mesh 152 deforms and applies a force to the outstretched arm.

The mesh 152 is generally formed from an elastic material having stretchable fibers such that the material can deform in a resilient or resistive manner to outstretched appendages (hands) and apply a restrictive force in a spring-like manner to oppose the extending movement. Generally described as an elastic mesh, such a mesh may be fulfilled by any elastic, rubber, deformable or resilient material having properties of increasing resistance and a tendency to return to an undistorted, unelasticized state.

Figure 2:
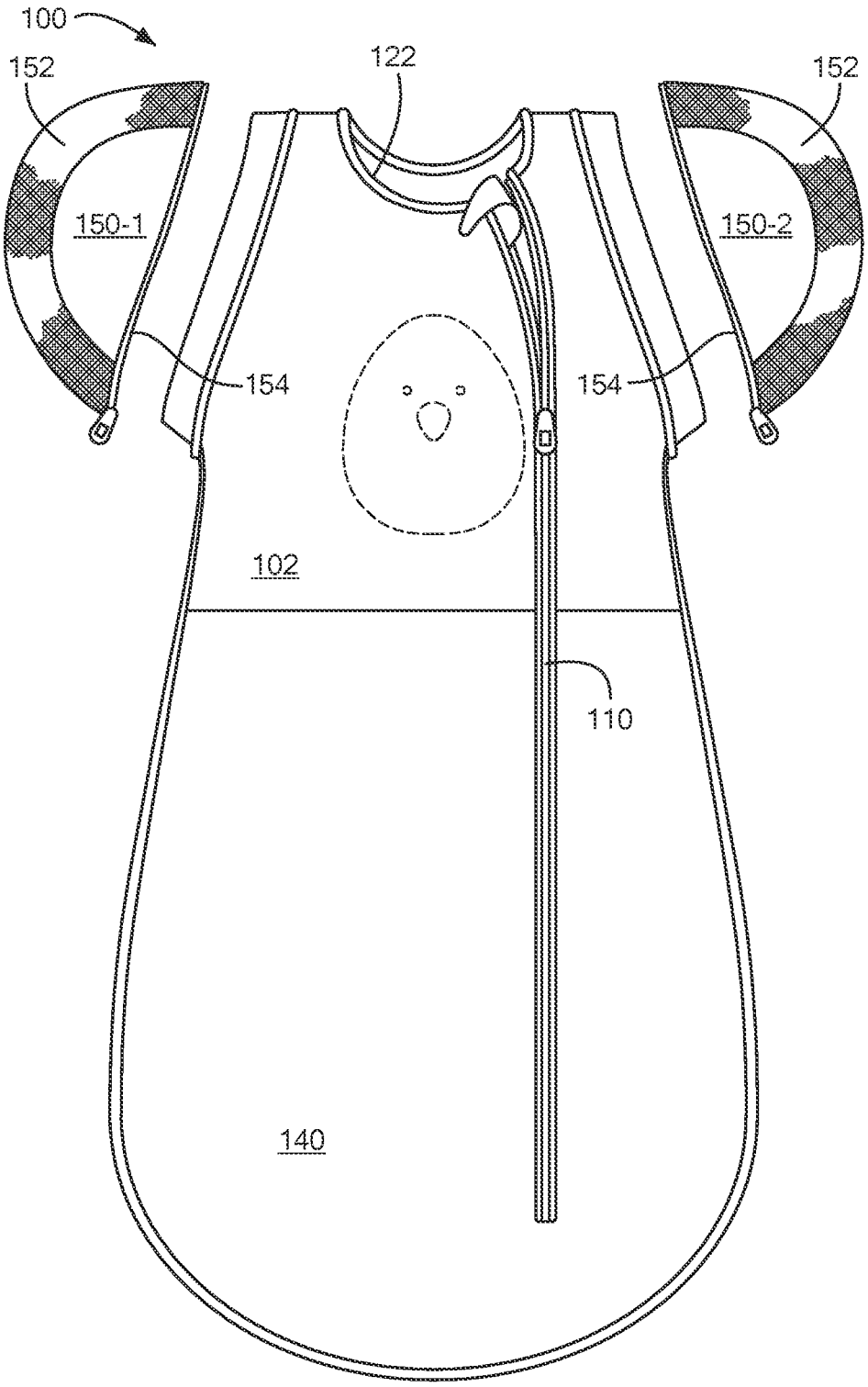
FIG. 2 shows the garment of FIG. 1 with the arm receptacles detached.

FIG. 2 shows features of a particular configuration of the garment 100 of FIG. 1 with the arm receptacles 150 detached. Referring to FIGS. 1 and 2, the full garment 100 as shown, therefore, takes the form of head-to-toe infant apparel having a zippered or similar closure 110 and common pouch 140 for both legs, in a so-called "legless" manner. Pressure accessories such as those described in U.S. Pat. Nos. 9,572,376 and 8,863,329 may also be included. The receptacles 150 replace conventional sleeves and take the form of a closed, semicircular protrusion attached by a zippered seam 154 for removal as infant growth proceeds. The mesh 152 portion occupies the outer circumference of the semicircular shape, and the zipper seam 154 provides selective attachment across a diameter of the semicircle where the arm receptacles join the garment 100.

The arm receptacle 150 has a fixed or rest position that does not rise above or beyond the shoulder line of the garment 100. Therefore, a restrained sensation to a flailing action is perceived sooner, rather than when the arms have risen well above the shoulders. By engaging the arms early into the flail action, the resilient mesh 152 contacts the hand/arm and begins exerting the resistive force that calms the infant. Rather than outright tensioned restriction of the arms, as with conventional, snug swaddles, the semicircular shape allows freedom of movement and partial upward displacement in a flail response, but limits movement such that the resilient mesh 152 engages and contacts the moving arms before a full flail response awakens the infant. The undeformed mesh 152 therefore is below or aligned with the arm limit at the uppermost shoulder or head opening 120, while deformable extension may temporarily occur in response to the mesh 152 disposed by a hand or arm as the mesh 152 responds to a flail or movement and provides elastic resistance in response.

In an example configuration as disclosed herein, the infant sleeping garment 100 is constructed of a textile body 102 adapted to encircle and engage the infant from the shoulder line to the feet in an appendageless, open void that does not have tubular leg or arm receptacle structures. The feet and legs remain together in a common pouch 140, and the arms are defined by semicircular regions having a textile portion and a resilient mesh 152 portion. A band or strap, discussed further below, may also assist in leg support within the pouch 140. The closure 110 may be a double ended zipper on the front of the textile body for facilitating entry and exit of the infant from the garment, however any suitable closure mechanism may suffice.

Figure 3:
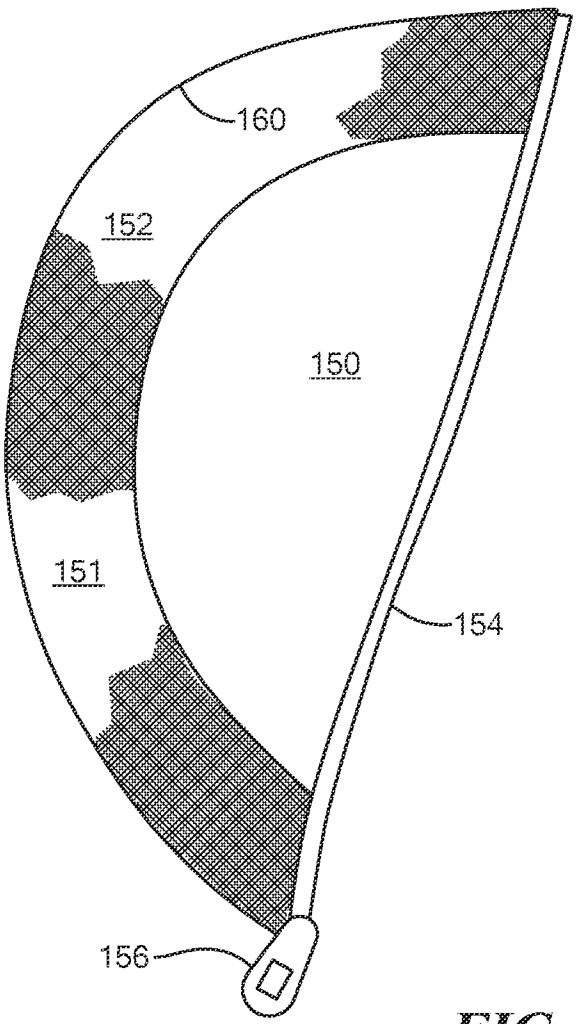
FIG. 3 shows the semicircular arm receptacle, detachment zipper and outer circumference mesh portion.

FIG. 3 shows a semicircular configuration of the arm receptacle 150, detachment zipper 154 and tab 156, and the outer circumference or perimeter 160 of the mesh 152 portion. Referring to FIG. 3, the semicircular perimeter 160 defines an outer radius of movement and an upper limit of movement for preventing flailing above the shoulder line. The resilient mesh 150 may have a weave 151 or fiber structure that exerts a greater resistive force to tension in a first direction than in a perpendicular direction. The material may therefore exhibit greater flex or travel in a horizontal direction than in a vertical direction, or vice versa. For example, the resilient mesh 152 may exert a greater resistance across a width of the arm receptacle than along the length of the perimeter.

Figure 4:
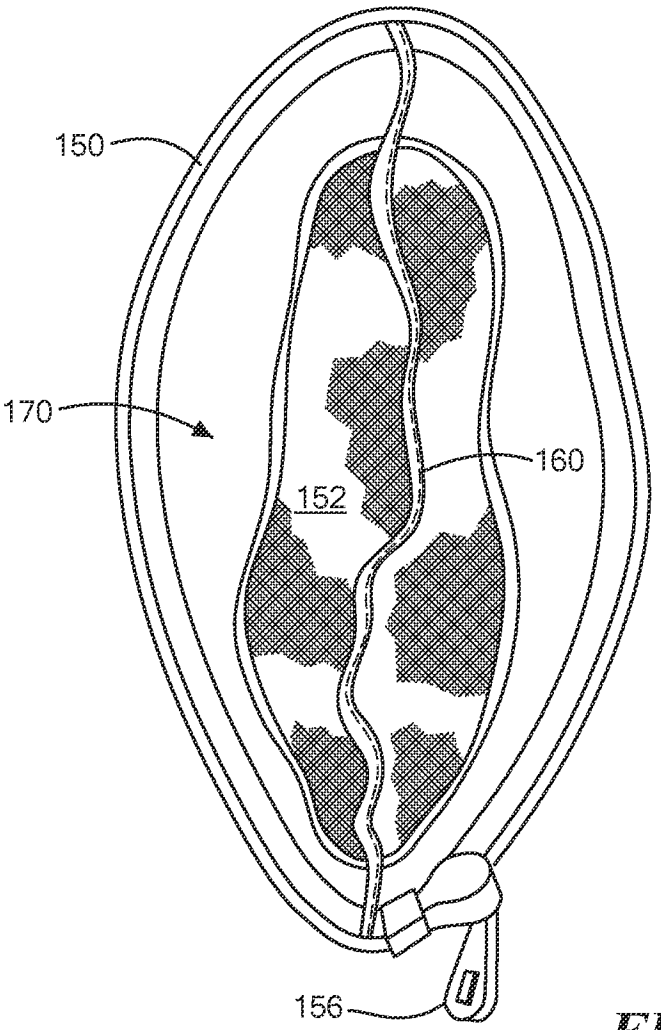
FIG. 4 shows the interior void of the arm receptacle extending to the outer circumferential mesh.

FIG. 4 shows an interior void 170 of the arm receptacle 150 extending to the outer circumferential mesh 152. Referring to FIG. 4, the resilient mesh occupies a region around the outer perimeter 160 of the semicircular shape of the arm receptacle 150 for permitting maximum freedom of movement within the arm receptacle 150. The mesh 150 is then allowed to deform upon approaching a maximum range defined by the outer perimeter 160 in response to curtailing a flail reflex. The void 170 defines the volume accessible for movement by the infant arms to avoid a constrained feeling. The mesh 152 also allows light transmission for visual confirmation of limb movement within arm receptacles, for observation by a parent or caretaker.

The opposed arm receptacles 150 therefore flank the opening 120 for receiving the arms of the infant, such that each of the opposed arm receptacles has the resilient mesh 152 adapted to engage the arms and exert a resistive force responsive to arm movement when disposed towards a level of the opening 120 in the direction of the head. The resilient mesh 152 is adapted to expand along either of two dimensions defined by the mesh surface, thus expanding in all directions along its planar surface, subject to a unidirectional weave as described above. The mesh is also resistant to fluid absorption so as to remain unsaturated despite an infant's tendency to insert hands and fingers into the mouth (thumbsucking), drooling, etc., which can draw the mesh 152 to or near the mouth opening.

Figure 5:
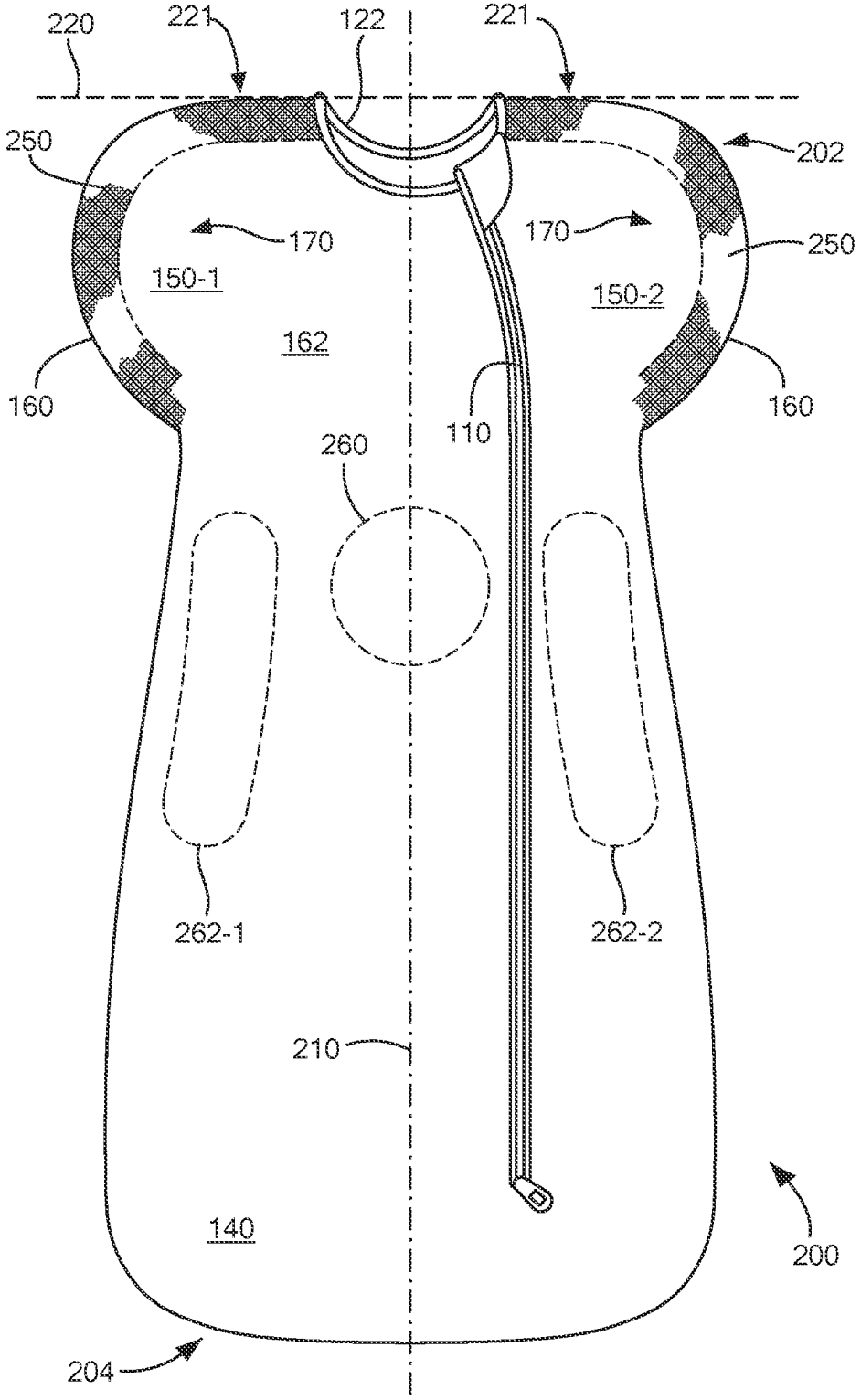
FIG. 5 shows a schematic of the garment structure and outline.

FIG. 5 shows a schematic of the garment structure and outline detailing orientation and construction of the garment 100. Referring to FIGS. 1-5, the textile body 102 defines a generally elongated shape 200 for enclosing an infant, including a proximate end 202 extending to the opening 120, and a closed distal end 204 for enclosing legs and feet of the wearer. A central axis 210 extends between the arm receptacles 150 from the closed distal end 204 to the proximate end 202. An arm limit 220 defined by a shoulder line runs perpendicular to the central axis 210 along the proximate end 202.

The opposed arm receptacles 150 form a semicircular or other structure for receiving the arm, and the resilient mesh 152 takes the form of an elongated strip 250 along the outer perimeter of the semicircular arm receptacle. The semicircular design provides the void 170 or pouch for permitting infant arm travel in all directions, rather then confinement to a tubular sleeve. Upon movement toward the perimeter 160 of the semicircular arm receptacle 150, contact is made and the resilient mesh 152 begins to deform or stretch to accommodate slight additional movement. A resistive force is felt from the elasticity of the mesh 152 as the infant continues to push, providing tangible feedback that emulates a caretakers touch or hold.

In further detail, the resilient mesh 152 takes the form of a strip 250 on the outer perimeter 160 of the arm receptacle 150 protrusion, and has an unexpanded position and an elasticized position. The mesh 152 achieves the unexpanded position when it is not engaged by the arm and at rest, not being pushed or contacted by the wearing infant. In contrast, the elasticized position exerts pressure against the arm as the elasticized resistance of the mesh 152 increases in response to greater arm force. Movement is provided within the void of the arm receptacle even while the mesh remains unexpanded, allowing the infant an unstrained feeling. While at rest, the unexpanded position of the mesh 152 arm receptacle 150 disposes the arm below the arm limit 220 defined by the opening 120, maintained by resilient deformation of the mesh 152 in response to a flailing movement.

The leg cavity 140 at the closed distal end 204 is responsive to leg movement resulting from knee flexure of the wearer. Rather than snugly securing the legs as a tight swaddle, movement of the hips and knees can be beneficial to proper development.

The garment 100 may also employ a weighted pressure accessory 260 on the textile body 102 along the central axis 210 between or slightly below the opposed arm receptacles 150, as disclosed in the related U.S. patent applications cited above. The closure 110 is slightly off center to extend just adjacent to the weighted pressure accessory 260. There may also be weighted pressure accessories 262-1, 262-2 (262 generally) disposed on the textile body 102 adjacent to at least one of the arm receptacles 150, detailed further in the above cited applications.

Figure 6:
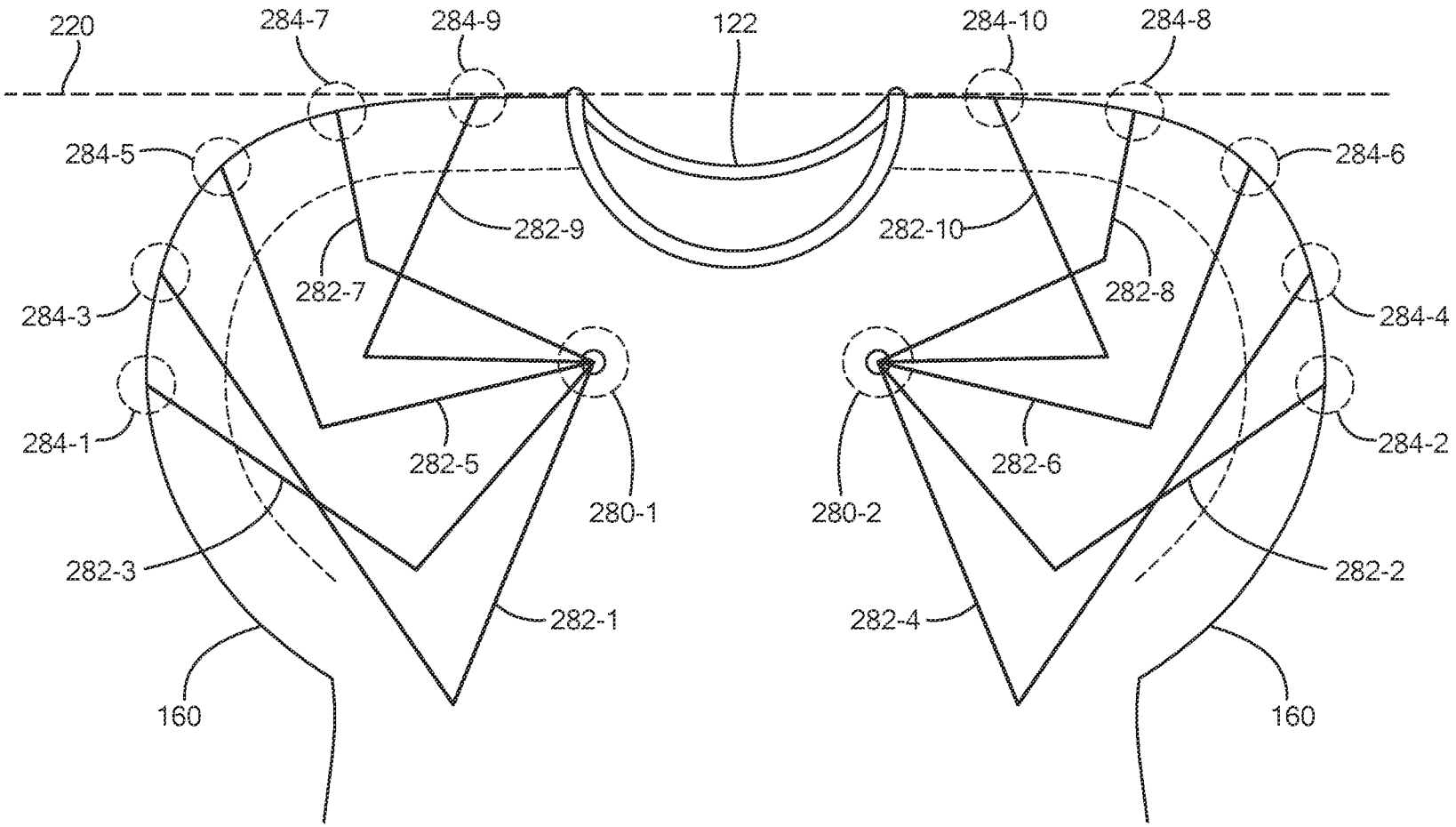
FIG. 6 shows boundaries imposed on limb movement bu the garment structure of FIG. 5.

FIG. 6 shows boundaries imposed on limb movement by the garment structure of FIG. 5. Referring to FIGS. 5 and 6, the arm receptacles 150 have a semicircular perimeter 160 that runs tangent to the arm limit 220 at a point 221 along the proximate end 202 and extends towards the distal end 204 for enclosing arms of the wearer. The arm limit therefore defines an extreme position of each of the opposed arm receptacles 150, as the arm limit 220 extends across the opening 120 for at least a portion of the opening 120 aligned with the arm limit 220. The arm limit 220 defines an upper boundary of the garment 102 generally corresponding to a shoulder of the wearer.

In FIG. 6, example movement paths of an infant's arm and hand are shown. Such movement is pivotal defined primarily by shoulder and elbow joints, and to a minor extent the wrists. Shoulder axes 280-1, 280-2 (280 generally) depict example pivot locations approximating a position of a wearer's shoulder. Movement paths 282-1 . . . 282-10 (282 generally) depict angular orientations of the elbow and corresponding extent 284-1 . . . 284-10 (284 generally) of the hands based on the path 282. Odd subscripted paths on the left 282-1 . . . 282-9 terminate at the extent 284 along the perimeter 160, increasing towards the head region (upwards, as shown) until the perimeter 160 runs tangent to the arm limit 220 at the maximum upper travel at 284-9. Similarly, the even subscripted paths 282-2 . . . 282-10 on the right show extents up to 284-10, as perimeter 160 runs tangent to the arm limit 220 (right and left designations are based on the reader, not on the garment/infant perspective). In this manner, the semicircular perimeter 160 defines an arc of movement around a pair of axis points exerted by a garment wearer, i.e. shoulder and elbow joints depicted as the respective paths 282. The resulting upper limit is based on an uppermost point resulting from pivots around two axis points, the upper limit defined by the arm limit 220.

Figure 7B:
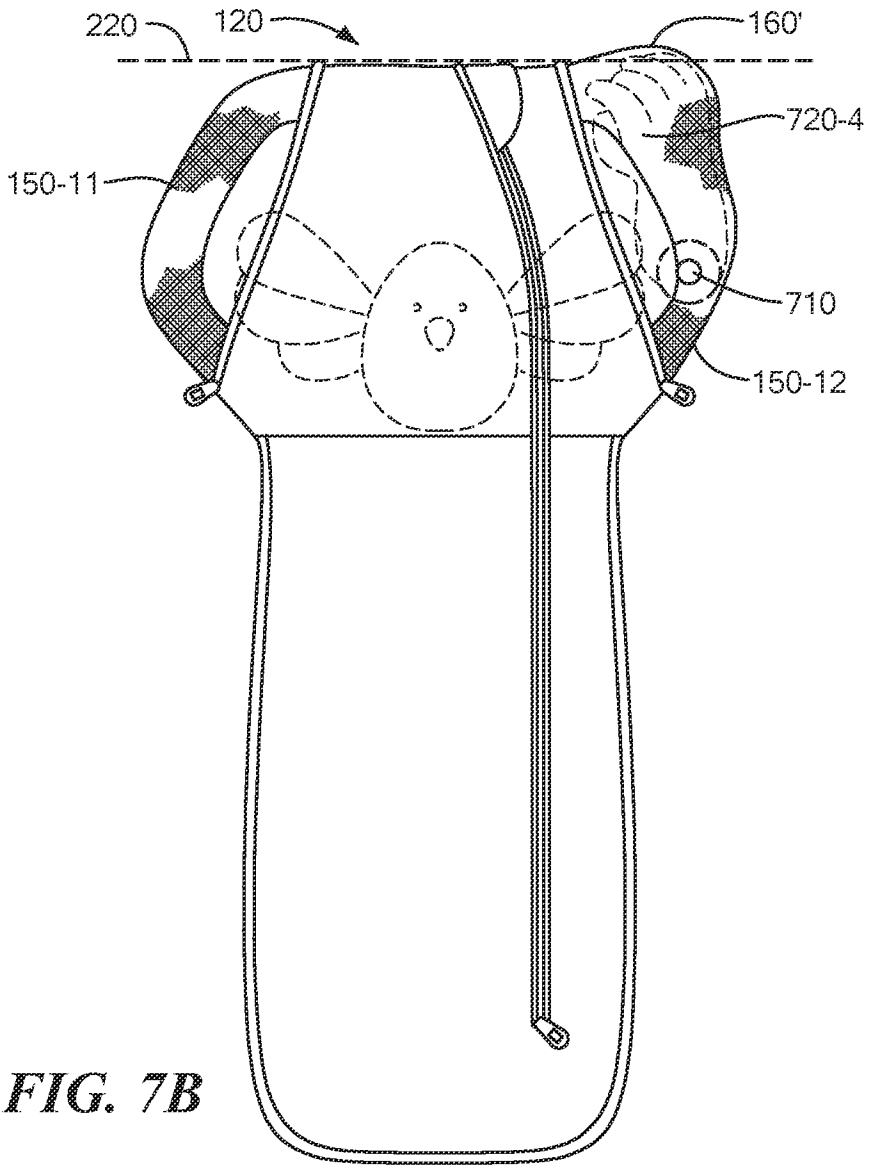
FIGS. 7A and 7B show deformation of the receptacle mesh for accommodating movement while implementing the anti-flail response.
Figure 7A:
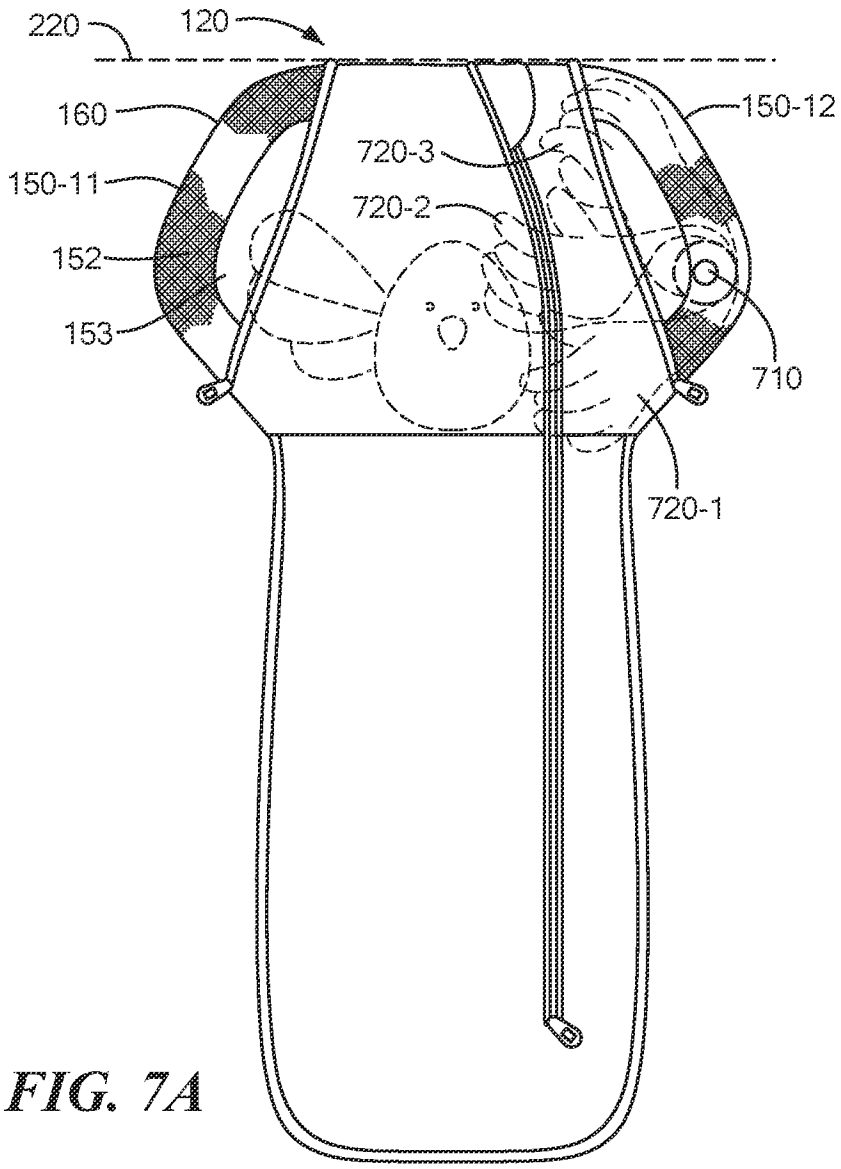

FIGS. 7A and 7B show deformation of the receptacle mesh for accommodating movement while implementing the anti-flail response. The configurations of FIGS. 7A and 7B show deformation of the mesh portion responsive to arm movement, and constraint or resistance by the elastic mesh 152 to bias or return the arm to a rest position. Referring to FIGS. 7A and 7B, the receptacles 150 may take on any suitable shape having a concave cavity or void for receiving an infant arm, and generally appear as a semicircular or polygonal shape. Receptacles 150-11 and 150-12 illustrate a trapezoidal profile, having mesh 152 adjacent the outer perimeter 160, and a basal material region 153 inward toward the torso region.

The mesh generally has a greater deformability than the basal textile material, such that the more flexible mesh can stretch to a greater degree. Further, the basal material 152 may be comprised of a knit that restricts deformability in one direction. In other words, the basal material may be more resistive to stretching along a width, and allow a ability to stretch along its length. The mesh 152 allows stretching in all directions, to gently receive an outstretched hand and gently deform or expand, and then exert a gentle contraction to bring the arm back.

Any suitable arrangement and ratio of mesh 152 and basal 153 material may be employed to form the receptacles. The mesh may define a "strip" or segment on the outer (perimeter), middle (flanked by basal 153) material or an innermost portion adjacent the torso. The basal material 153 may be any textile composition having a greater firmness, while the mesh 152 is generally more elastic than the basal material 153, and is also transparent for visual observation of the infant arm movement.

FIG. 7A shows an outline of a moving or flailing arm in several positions 720-1 . . . 720-4 (720 generally). Arm position 720-1 is downward and substantially aligned with a lower edge of the receptacle 150-12. As the arm is raised to position 720-2, about an axis 710 defined by an elbow, the arm is substantially transverse. At position 720-3, the arm and hand align with an upper edge of the receptacle 150-12, where the hand begins to contact the mesh 150 and begin to deform. In FIG. 7B, the arm position 720-4 deforms the mesh as the perimeter 160' expands and rises above the arm limit 220. Upon attaining a maximum deformation, the mesh 150 becomes more restrictive as the perimeter 160' attains an outer limit. The mesh 150 continues to exert a return bias to the outstretched arm position 720-4 until the arm position 720 falls below the arm limit 220 as the mesh 150 attains a rest, or undeformed position.

Figure 8:
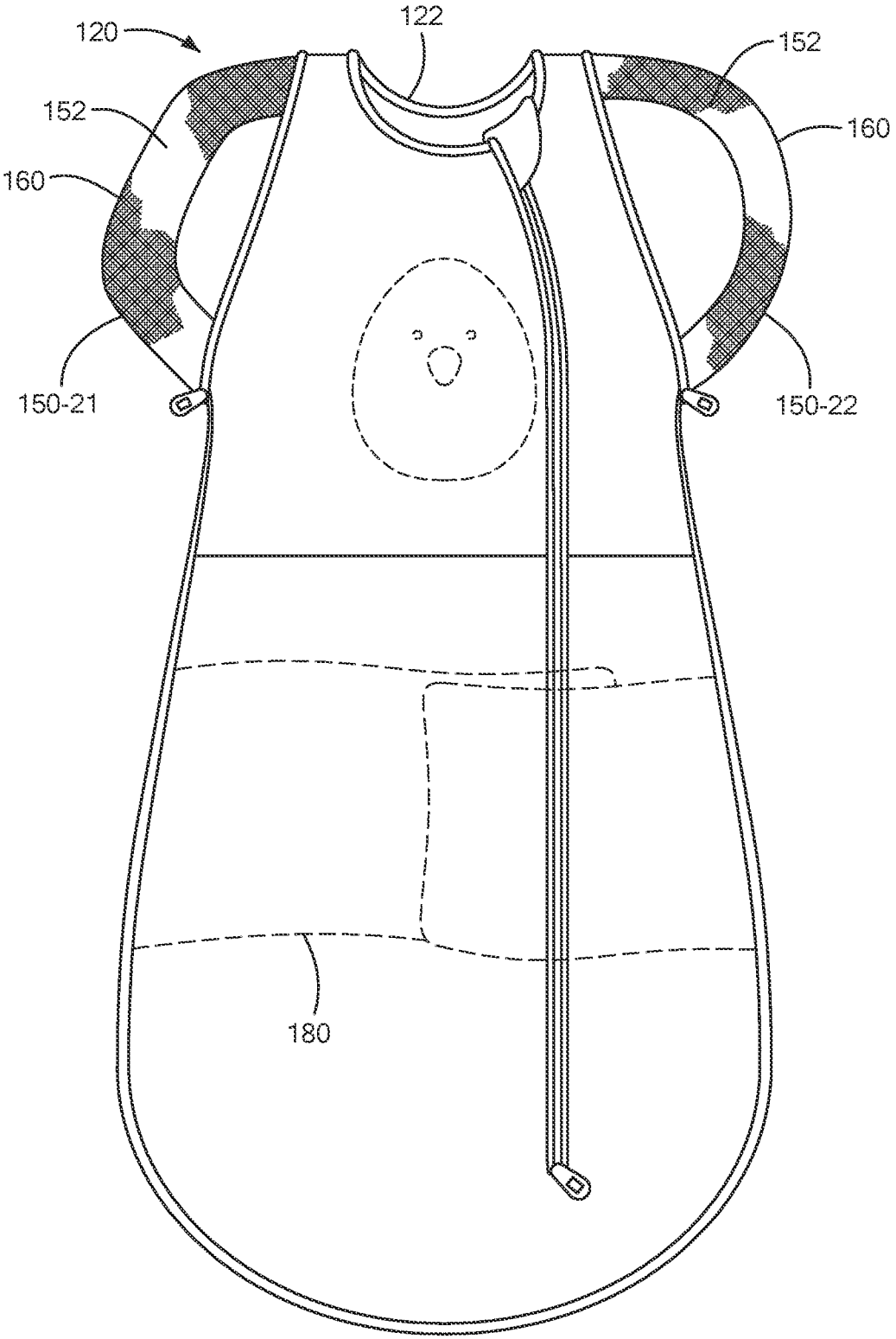
FIG. 8 shows an alternate configuration with a polygonal receptacle.
Figure 10:
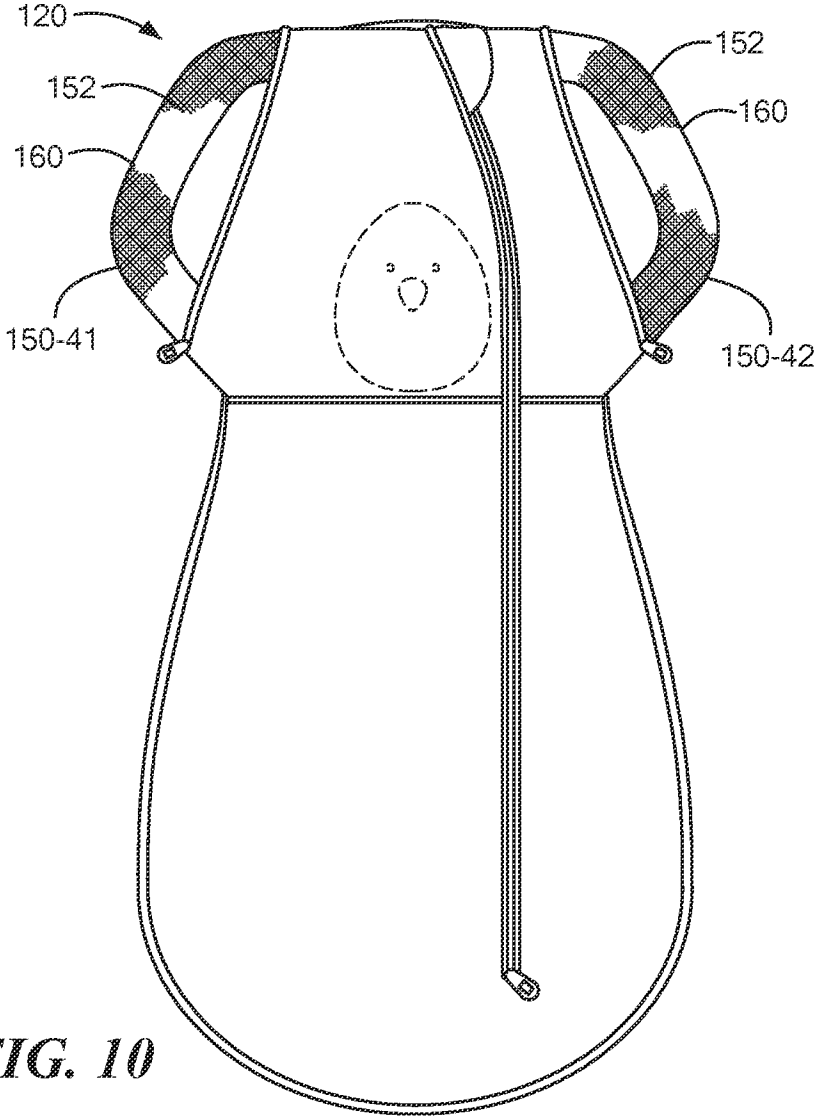
FIG. 10 shows a configuration with a larger perimeter arm receptacle.
Figure 9:
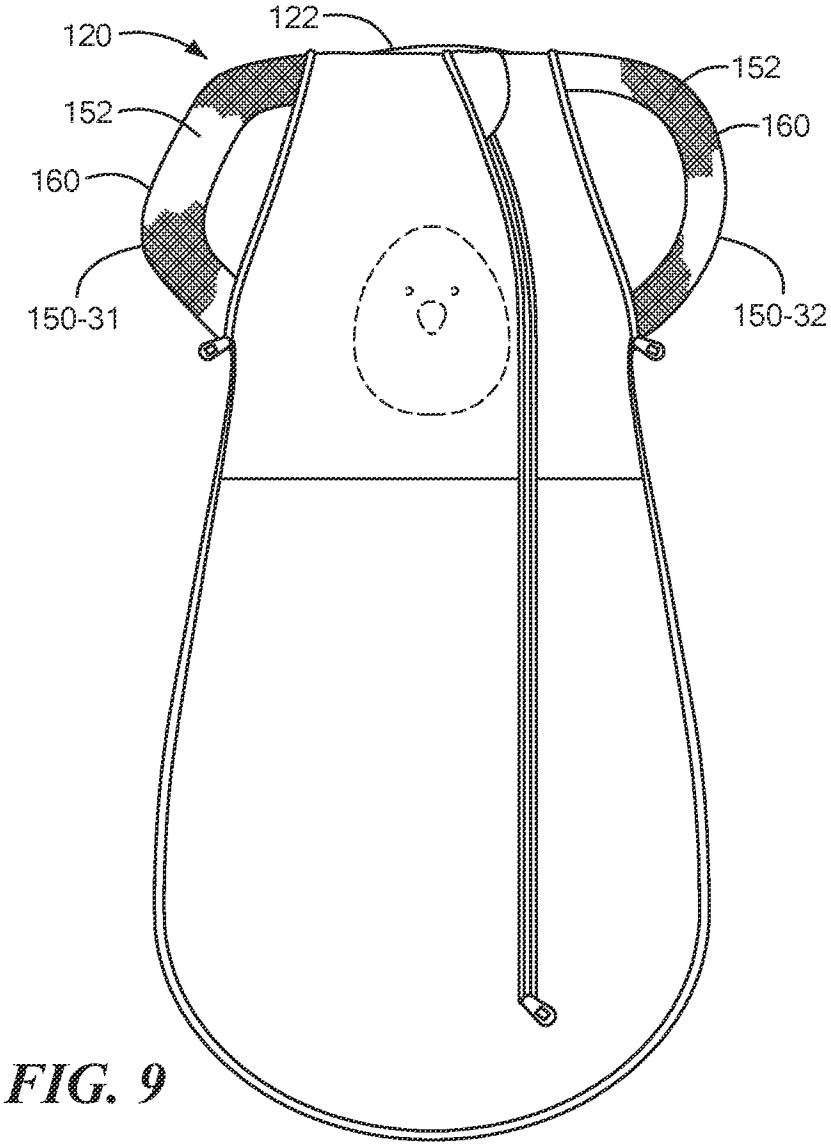
FIG. 9 shows an alternate configuration with a straight, or non-scooped head opening.

FIGS. 8-10 show alternate receptacle 150 configurations. Referring to FIGS. 5-10, FIG. 8 shows an alternate configuration with a polygonal receptacle 150-21 as in FIGS. 7A-7B, maintaining the scooped head perimeter 122. Another receptacle 150-22 has a deeper semicircular or elliptical shape, both with outer mesh 152 portions adjacent the perimeter 160. An optional strap or band 180 assists in securing the infant.

FIG. 9 shows an alternate configuration with a straight, or non-scooped head perimeter 122, as the opening 120 aligns with the arm limit 220. A well defined or scooped neck opening is not required with a smaller or infant body size, as the notion of a neck is less distinct. Receptacles are still shown as polygonal or trapezoidal 150-31, or semicircular 150-32.

FIG. 10 shows a configuration with a larger perimeter 160 arm receptacle 150-41, 150-41 as a lower region of the mesh 152 region extends lower on the torso then in FIGS. 8 and 9. The straight opening 120 is also employed. In general, the opening 120 and head perimeter 122 are independent and may be formed to accommodate varied sizes of arms and/or head clearance.

It should be further noted that the mesh 152 may encompass any suitable portion of the receptacle 150, such as the outermost or perimeter defined 160, as shown, or may form the entire receptacle 150.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. An infant sleeping garment, comprising: a textile body formed from a basal fabric adapted to engage an infant wearer of the garment; a closure on a front of the textile body for providing entry and exit of the infant from the garment; a head opening; and opposed arm receptacles each having a front and a back, the arm receptacles flanking the head opening for receiving the arms of the infant such that each arm receptacle encloses the respective arm completely, each of the opposed arm receptacles having an elastic mesh disposed on the front and the back to define an elongated strip adjacent the head opening and extending along an outer perimeter of the arm receptacle, and having an elasticity of a greater magnitude than the elasticity of the basal fabric; the elastic mesh further comprising an undistorted position and an expanded position, the elastic mesh achieving the undistorted position when not engaged by the infant, such that the undistorted position disposes the arm receptacle below a horizontal line defined by an uppermost limit of the head opening, and the expanded position deforming against exerted pressure from an arm of the infant.

2. The garment of claim 1 wherein the receptacles are adapted to restrict movement of arms therein from extending to a full extent in any direction around an elbow or shoulder joint, the elastic mesh biased for returning the extended arms to a position closer to the wearer's body.

3. The garment of claim 1 wherein the opposed arm receptacles define a pocket-like structure for receiving the arm, the elastic mesh forming at least a portion of the receptacle or the whole arm receptacle.

4. The garment of claim 1 wherein the textile body defines an elongated shape for enclosing an infant, further comprising:

a proximate end extending to the head opening; and a closed distal end for enclosing legs and feet of the wearer;

a central axis extending between the arm receptacles from the closed distal end to the proximate end; and an arm limit perpendicular to the central axis along the proximate end.

5. The garment of claim 4 wherein the arm receptacles have a semicircular or polygonal perimeter tangent to the radial distance of the arm limit, starting at the head opening and extending towards the distal end for enclosing arms of the wearer completely.

6. The garment of claim 5 wherein the arm limit defines a maximum unelasticized position of each of the opposed arm receptacles, the arm limit extending across a shoulder line of the garment and aligned with the head opening.

7. The garment of claim 5 wherein the semicircular or polygonal perimeter defines a limit of movement of the undistorted arm receptacles in response to movement exerted by a garment wearer.

8. The garment of claim 5 wherein the semicircular or polygonal perimeter defines an outer radius of unrestricted movement defined by the arm limit.

9. The garment of claim 5 wherein the elastic mesh is adapted to expand more readily than the basal fabric.

10. The garment of claim 5 wherein the elastic mesh is adapted to exert a lower resistive force than basal fabric.

11. The garment of claim 5 wherein the elastic mesh occupies a region around an outer perimeter of the semicircular or polygonal shape of the arm receptacle for permitting freedom of movement within the arm receptacle and deforming upon approaching a maximum range defined by the outer perimeter.

12. The garment of claim 11 wherein the elastic mesh is adapted to exert a lower resistance than the basal fabric in response to outward arm movement against the arm receptacle.

13. The garment of claim 11 wherein the elastic mesh has a greater resistance to fluid absorption than the basal fabric.

14. The garment of claim 11 wherein the mesh is adapted to allow light transmission for visual confirmation of limb movement within arm receptacles.

15. The garment of claim 3 further comprising a leg cavity at a closed distal end, the leg cavity responsive to leg movement resulting from knee flexure of the wearer.

16. The garment of claim 3 further comprising a weighted pressure accessory on the textile body along the central axis between the opposed arm receptacles, the closure extending adjacent the weighted pressure accessory.

17. The garment of claim 3 further comprising a weighted pressure accessory disposed on the textile body adjacent to at least one of the arm receptacles.

18. The garment of claim 1 wherein the elastic mesh is disposed for receiving an upward force and progressively deforming in resistance for return to the undistorted position.

19. The garment of claim 1 wherein the arm receptacle defines a cavity adapted to receive a pivoting elbow movement.

* * * * *